US005753355A

United States Patent [19]

Katsura

[11] Patent Number: 5,753,355

[45] Date of Patent: May 19, 1998

[54] COLLECTIVE HELICAL-ELEMENTS STRUCTURE

[75] Inventor: Nobuhiko Katsura, Omura, Japan

[73] Assignee: Nippon Laser & Electronics Lab., Nagoya, Japan

[21] Appl. No.: 632,269

[22] Filed: Apr. 15, 1996

[30] Foreign Application Priority Data

Apr. 20, 1995 [JP] Japan ..... 7-120471
Apr. 20, 1995 [JP] Japan ..... 7-120472

[51] Int. Cl.[6] ..... D03D 13/00

[52] U.S. Cl. ..... 428/222

[58] Field of Search ..... 428/222

[56] References Cited

U.S. PATENT DOCUMENTS 3,936,337 2/1976 Stapp ..... 156/167
3,970,495 7/1976 Ashton et al. ..... 156/162
4,265,981 5/1981 Campbell ..... 428/591

*Primary Examiner*—Helen Lee
*Attorney, Agent, or Firm*—Frishauf, Holtz, Goodman, Langer & Chick

[57] ABSTRACT

A helical structure with a high toughness includes a number of helical elements as an artificial substitute for collagen filament constituting a biological tissue, which can be easily exchanged for a part so as to permanently extend the service life, and which can be easily assembled into a required structure and vice versa. The helical elements are made of wiry materials with a predetermined diameter helically wound with a predetermined lead and pitch so that the diameter of the helix of the helical elements is about two times that of the wiry material. The form of the crest of the structure may correspond with that of the trough, and the trough may be located outside the center of the helix. A number of the helical elements are collectively solidified with their mutual troughs and crests united side by side.

12 Claims, 7 Drawing Sheets

COLLECTIVE HELICAL-ELEMENTS STRUCTURE

BACKGROUND OF THE INVENTION

1. Field of the Invention

The present invention relates to a collective helical-elements structure.

2. Description of the Related Art

In a living thing, the biological tissue such as a bone, tendon, blood vessel comprises resilient fibers in a helical structure, that is, the biological tissue is in a collective structure of a number of collagen filaments in a helical form of which respective crests and troughs are united side by side. Since this biological tissue dispersedly supports an applied external force on the helical slope of the respective collagen filaments united side by side, it has a high toughness. Furthermore, when some of the collagen filaments are damaged, the biological tissue exchanges the damaged collagen filaments with new ones according to the metabolism so as to maintain the tissue.

An object of the present invention is to provide a collective helical-elements structure which can obtain a high toughness in the same manner as in the biological tissue by using a number of helical elements.

Another object of the present invention is to provide a collective helical-elements structure which can be permanently used owing to easy exchange of the damaged parts even when some of the helical elements are damaged.

A further object of the present invention is to provide a collective helical-elements structure which is easy to be assembled into a required form or easy to be resolved from it.

In order to accomplish the objects, the collective helical-elements structure of this invention comprises a number of helical elements collectively solidified with their mutual troughs and crests united side by side, said helical element being made of a wiry material with a predetermined diameter and helically wound in the predetermined lead and pitch so that the diameter of the helix is about two times that of the wiry material. The form of the crest may correspond with that of the trough, and the trough may located outside the center of the helix.

DETAILED DESCRIPTION OF THE PREFERRED EMBODIMENTS

Referring to the accompanying drawings of the preferred embodiments, the present invention will be described hereinafter.

The First Embodiment

In FIG. 1 to FIG. 8, a number of helical elements 3 constituting a collective helical-elements structure 1 are made of wiry materials such as metal, synthetic resin, ceramics (including glass), concrete, and also made of natural fibers such as cellulose, hide or the like and carbon fibers.

Figure 1:
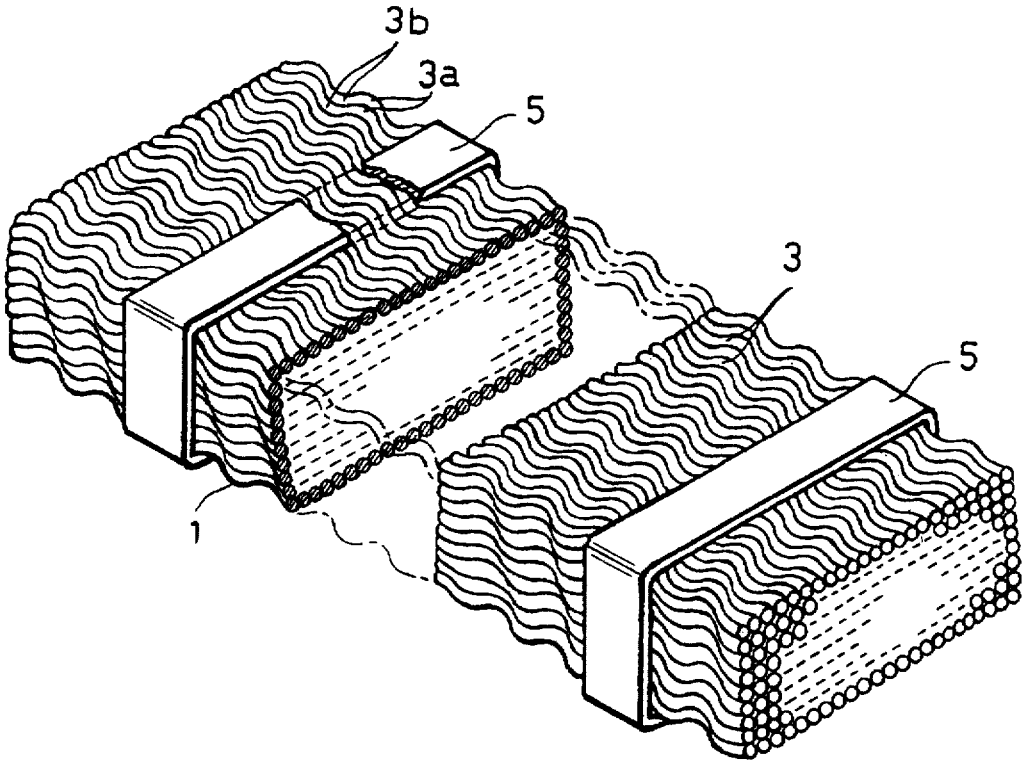
FIG. 1 is a schematic perspective view illustrating an outline of a collective helical-elements structure.
Figure 2:
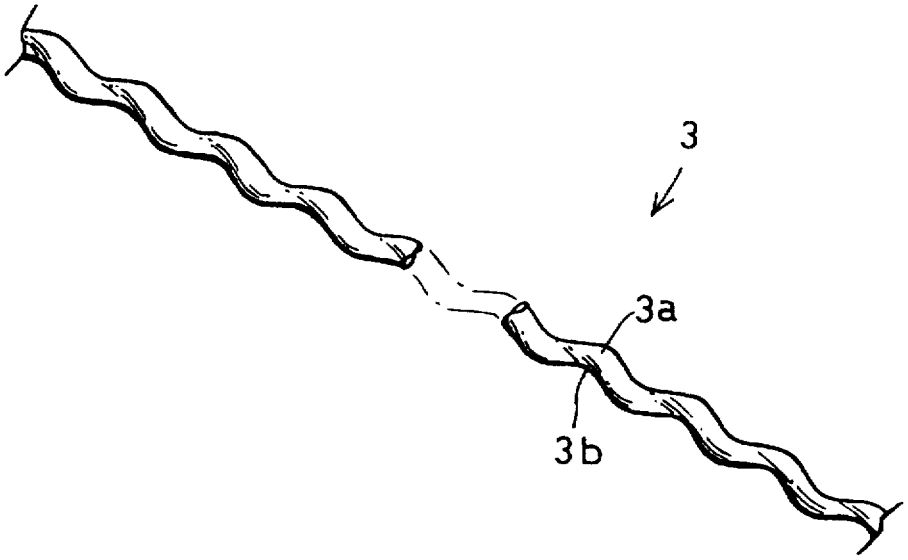
FIG. 2 is a schematic perspective view illustrating an outline of a helical element.
Figure 3:
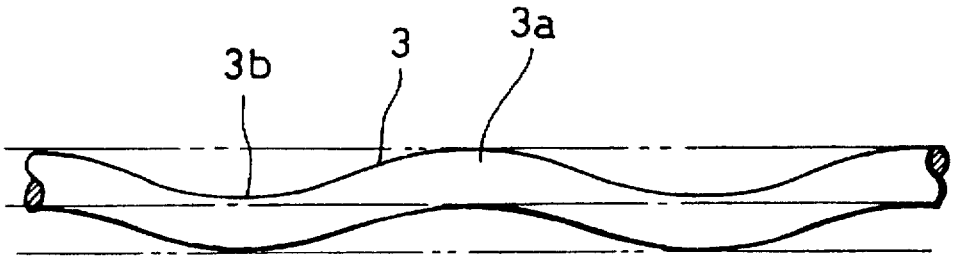
FIG. 3 is an enlarged plan view illustating a helical condition of a helical element.

As shown in FIG. 2 and FIG. 3, the helical element 3 is made of a wiry material helically wound in the predetermined lead and pitch so that the diameter of the helix may be about two times that of the wiry material, the form of the crest 3*a* may nearly correspond with that of the trough 3*b*, and the respective troughs may locate nearly on or outside the center of the helix. As a result, the respective troughs are wound so that the space in the central portion of the helix may be in the discontinuous condition in the axial direction. Incidentally, although the helical element 3 in FIG. 2 is shown as one helically wound in the right direction, it may be one helically wound in the left direction.

Then, a number of helical elements 3 arranged parallel in the mutual axes are collectively solidified so that the mutual crests 3*a* and troughs 3*b* may be united side by side to be formed into a collective helical-elements structure 1. For the solidifying method, any of the following ones may be allowable; bundling or hooping, with metal bands 5, a part or nearly the whole of the helical elements; tightening the elements by elastic force of coil springs wound around the external surface of them; or bolting or welding metal sheets which are bent so as to correspond with the external form of the collective helical-elements structure 1. Besides, the form of the collective helical-elements structure 1 may be allowable in any of a cylindrical pillar, square pillar, hollow tube (including a cylinder and square tube), board and sheet of a proper thickness, or the like.

Figure 4:
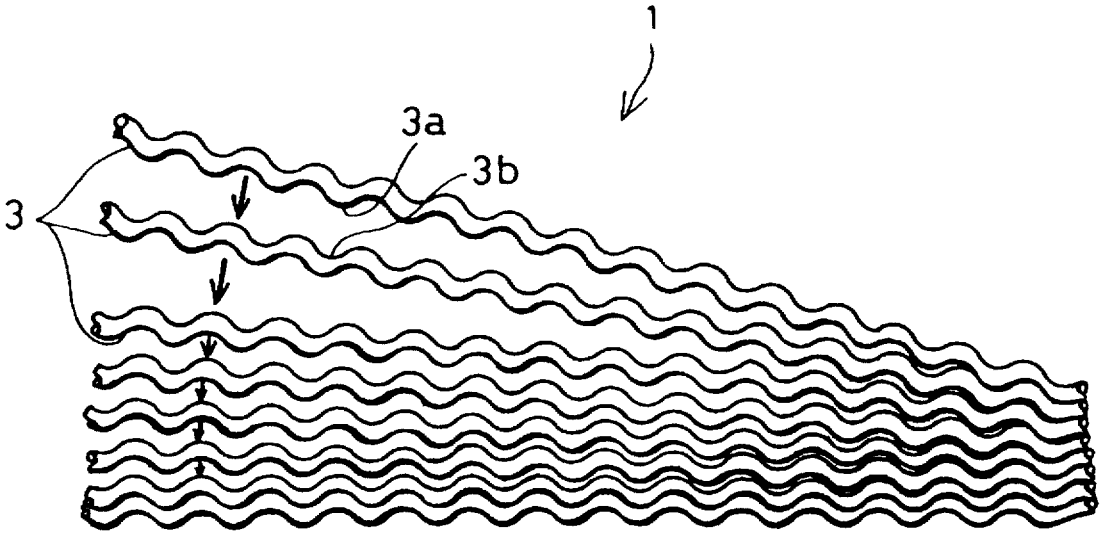
FIG. 4 is a plan view illustrating a collective condition of helical elements.
Figure 5:
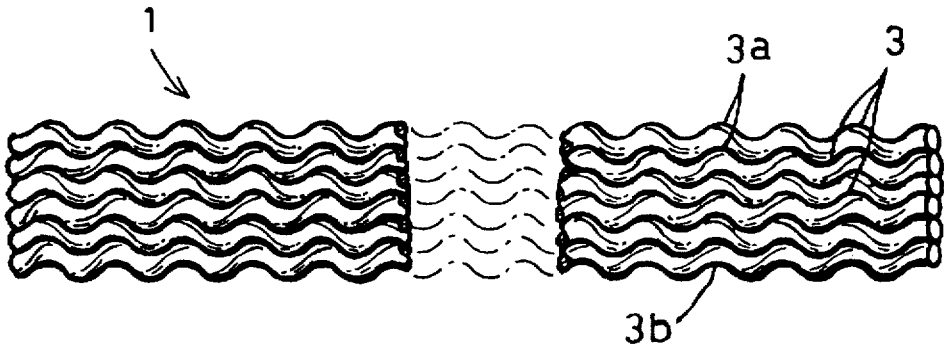
FIG. 5 is a schematic plan view illustrating another collective condition of helical elements.
Figure 6:
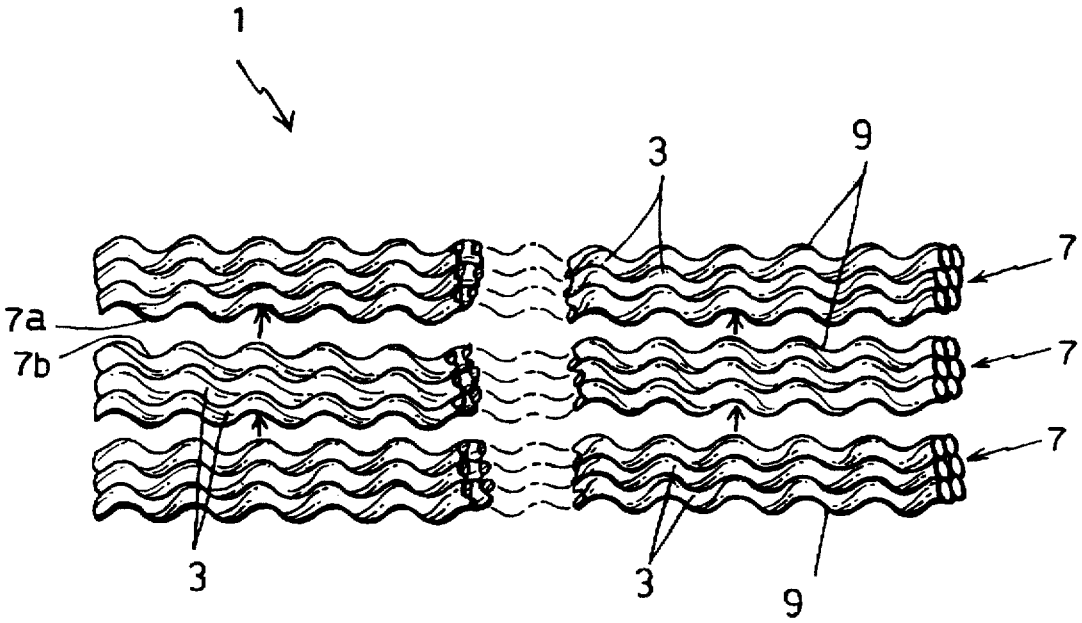
FIG. 6 is a schematic plan view illustrating a further collective condition of helical elements.
Figure 7:
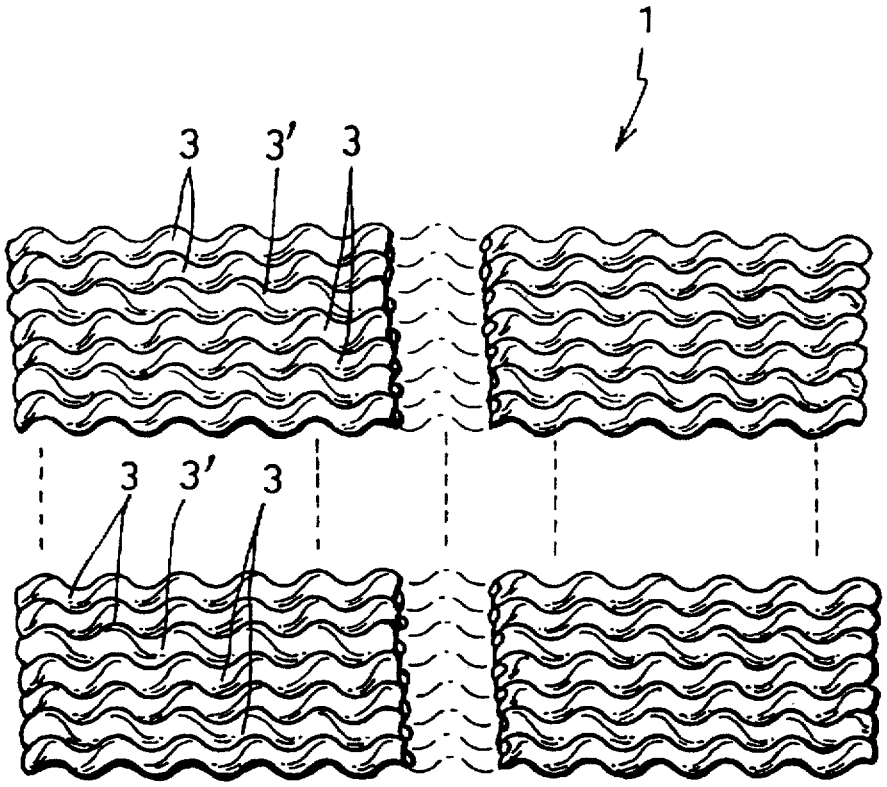
FIG. 7 is a schematic plan view illustrating a further collective condition of helical elements.

For the method of collecting the respective helical elements 3, any of the following ones may be allowable; wherein the respective helical elements 3 are arranged, as shown in FIG. 4, in the same winding direction of the helix, for example, either clockwise or counterclockwise so that the mutual crests 3*a* and troughs 3*b* may be united side by side; wherein the respective helical elements 3 are arranged, as shown in FIG. 5, in the mutually opposite winding directions of the helix so that the mutual crests 3*a* and troughs 3*b* may be united side by side; wherein a number of groups 7 of the helical elements are arranged, as shown in FIG. 6, in the mutually opposite winding directions of the helix so that the mutual crests 7*a* and troughs 7*b* may be united side by side, which each group comprises a plurality of the helical elements 3 united side by side in the same winding directions of the helix; and wherein a number of said helical elements 3 united side by side in the same winding direction of the helix are, as shown in FIG. 7, mixed and united side by side with the predetermined ratio of the helical elements 3' in the opposite winding direction of the helix.

Since the collective helical-elements structure 1 constitued as described above dispersedly supports an applied force on the helical slope of the crests 3a and troughs 3b of the respective helical elements 3 united side by side, it has a high toughness. Furthermore, since the mutual crests 3a and troughs 3b are united side by side in the helical elements 3 constituting the above-described collective helical-elements structure 1, the helical element 3 itself can not be drawn out straightly. Consequenlty, the collective structure 1 can maintain the steady form thereof during a long period of time. That is, the collective helical-elements structure 1 provides the high toughness as it maintains the steady form thereof during a long period of time.

Figure 8:
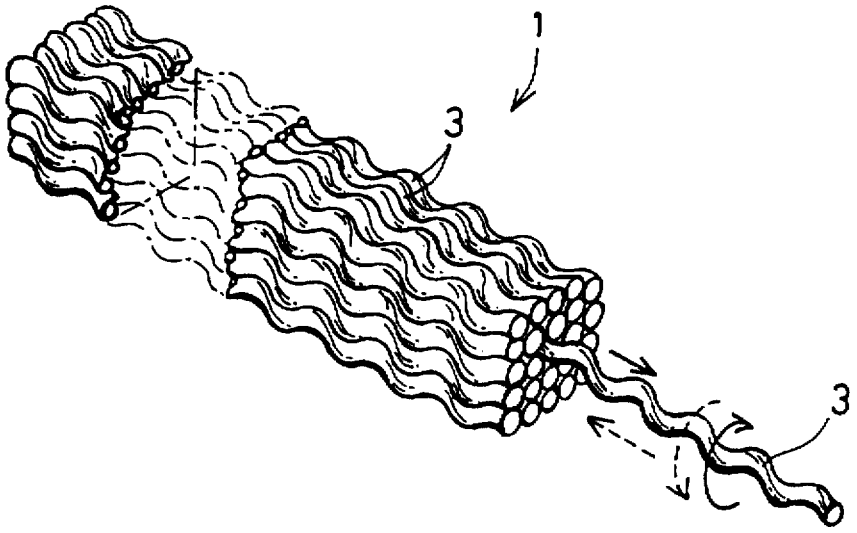
FIG. 8 is a perspective view illustrating a condition of exchanging a helical element.

On the other hand, if some of the helical elements 3 in the collective helical-elements structure 1 are damaged or corroded due to the usage during the long period of time, the damaged helical elements 3 can be easily exchanged to new helical elements 3, so that it is possible to maintain the initial performance of the collective helical-elements structure 1 and to use it permanently. That is, for the exchange of the damaged helical elements 3, although it is not possible to draw out the helical element 3 straightly, it is easy to take out the damaged helical elements 3 by rotating them as shown in FIG. 8. Then, the exchange can be performed in the manner that the new helical element 3 is, as rotated in the direction opposite to the above-described one, installed, so that the mutual troughs 3b and crests 3a may be united side by side, into the hollow space of the collective helical-elements structure 1 where the damaged helical element 3 has been taken out. Consequently, the partial exchange of the helical elements 3 can be easily performed in the collective helical-elements structure 1 so as to maintain the initial performance of the structure 1.

Furthermore, it is possible to assemble a structure in the required configuration by mutually combining a number of the collective helical-elements structures 1 constituted as described above and vice versa.

Second Embodiment

Next, another embodiment of the helical structure will be described.

Figure 9:
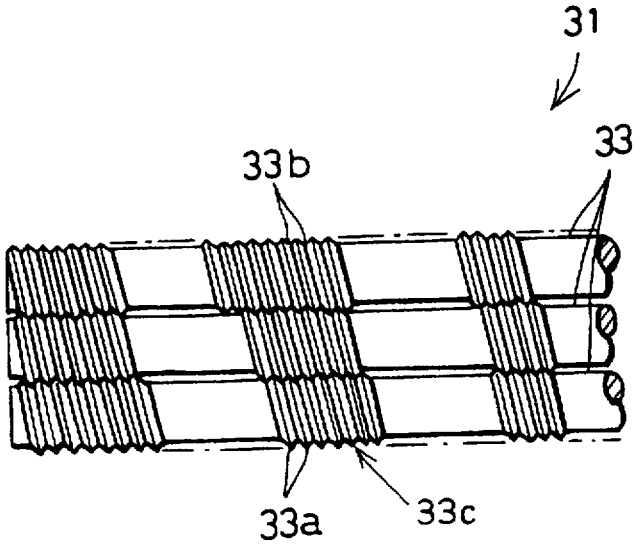
FIG. 9 is a plan view illustrating another collective helical-elements structure.
Figure 10:
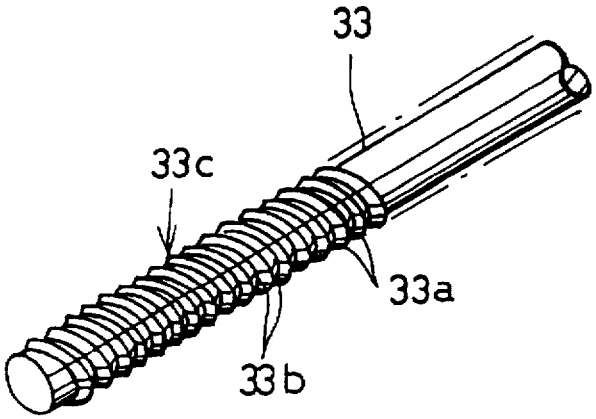
FIG. 10 is a schematic perspective view illustrating another helical element.

In FIG. 9 and FIG. 10, a number of helical elements 33 constituting a collective helical-elements structure 31 are made of axial materials of metal or synthetic resin, on the peripheral surface of which are formed helical grooves 33c with crests 33a and troughs 33b nearly corresponded with each other in the predetermined lead and pitch. The troughs 33b are located outside the center of the axis in the helical element 33 in the same manner as in the helical element 3 as described above.

The respective helical elements 33 made of the above-described axial materials are collectively solidified into a required form so that the crests 33a and troughs 33b may be united side by side so as to form a collective helical-elements structure 31.

For the method of collecting the respective helical elements 33, any of the following ones may be allowable; wherein the respective helical elements 33 are arranged in the same winding direction of the helix in the same manner as in the helical elements 3 of the above-described collective helical-elements structure 1; wherein the respective helical elements 33 are arranged in the mutually opposite winding directions of the helix; wherein a number of groups of the helical elements 33 are united side by side in the mutually opposite winding directions of the helix, which each group comprises a plurality of the helical elements 33 united side by side in the same winding direction of the helix; and wherein a number of the helical elements 33 united side by side in the same winding direction of the helix are mixed and united side by side with the predetermined ratio of the helical elements 33 in the opposite winding direction of the helix.

The above-described collective helical-elements structure 31 have the high toughness as well as the above-described collective helical-elements structure 1. Furthermore, if a part of the structure 31 is damaged, the damaged helical element 33 is taken out as the element 33 is rotated, and then a new element 33 is installed as it is rotated so as to accomplish the exchange.

Figure 11:
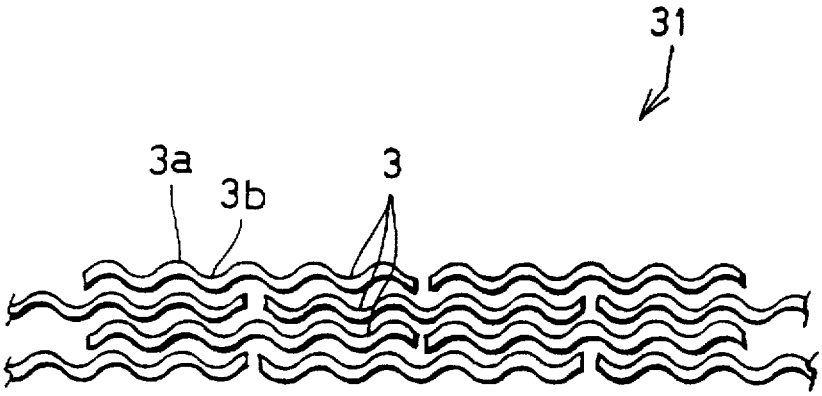
FIG. 11 is a schematic plan view illustrating another embodiment.

For using helical elements 3, 33 of short axial length, a number of helical elements 3 are, as shown in FIG. 11, shifted each other by the predetermined length in the axial direction to be arranged in the zigzag condition and united side by side so as to form a required configuration, that is, a collective helical-elements structure 1 of long size. Incidentally, although FIG. 11 illustrates helical elements 3 of wiry material united side by side in the zigzag condition, it is the same with helical elements 33 of axial material, so that the illustration is omitted. In addition, althouth FIG. 11 illustrates the helical elements in the condition shifted each other by ½ of the respective axial length, they are not limited to this condition. Also, in case of forming a long-size collective helical-elements structure 31 by using the helical elements 33 of axial material, it is possible that one end surface of each helical element 33 is provided with an engaging projection and the other end surface is provided with an engaging hollow so as to couple the respective helical elements 33 each other in the axial direction by connecting the engaging projection into the engaiging hollow.

Figure 12:
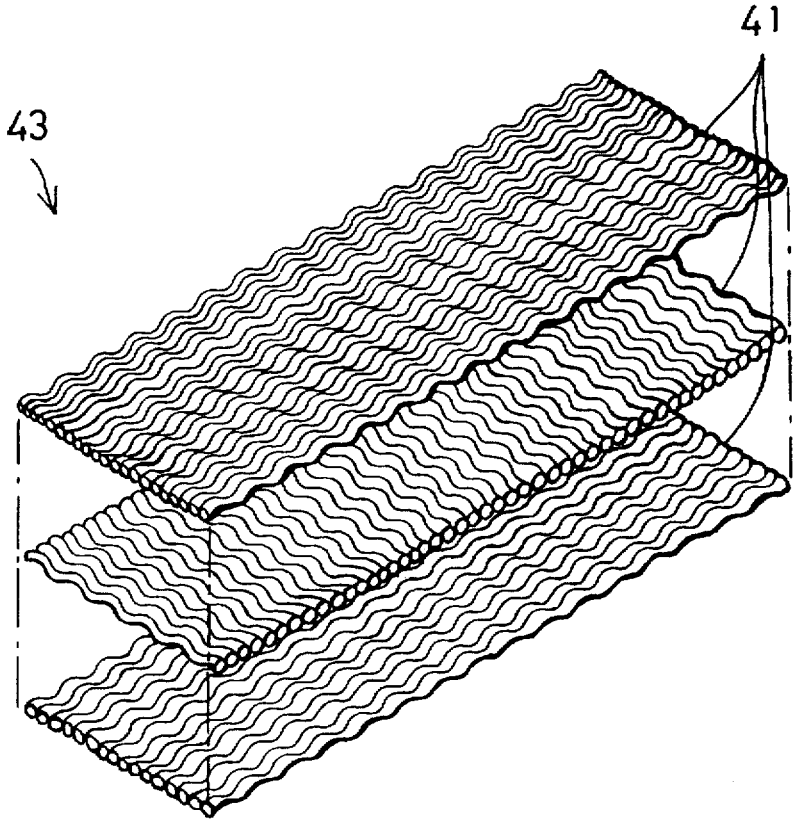
FIG. 12 is an exploded perspective view illustrating another embodiment.

Furthermore, in case of forming the collective helical-elements structure 1 and the helical structure 31 in a sheet configuration, when a plurality of sheet-like collective helical-elements structures 41 formed in a sheet configuration are collected into a predetermined form so as to be made in layers in the relationship where the mutual directions of the axes are at right angles, it is possible to form a sheet-like collective helical-elements structure 43 which is tough and strong against deformation. Incidentally, although FIG. 12 illustrates the collective helical-elements structure 1 comprising the helical elements 3, it is the same with the collective helical-elements structure 31 using the helical elements 33, so that the illustration is omitted. Furthermore, althouth in FIG. 12 the sheet-like collective helical-elements structure 41 is formed with a number of sheet-like helical elements 3 in the same winding direction of the helix, it is allowable to use helical elements 3 in the opposite directions to form the respective sheet-like collective helical-elements structures 41.

The collective helical-elements structures 1, 31 or sheet-like collective helical-elements structure 41 constituted as described above can be used as pillar, wall and board materials for constituting buildings. For this usage, those structures display a feature that those have superior toughness and are strong against the deformation. Furthermore, even if a part of the structure is damaged, it is possible to easily exchange the damaged part so as to extend the endurance life.

What is claimed is:

1. A collective helical-elements structure, comprising a number of helical elements forming a helix collectively solidified with their mutual troughs and crests united side by side, said helical element made of an axial material having helical grooves formed on the peripheral surface so that the form of the crest may correspond with that of the trough.

2. A collective helical-elements structure as set forth in claim 1, wherein respective helical elements are united side by side in a same winding direction of the helix.

3. A collective helical-elements structure as set forth in claim 1, wherein respective helical elements are united side by side in mutually opposite winding directions of the helix.

4. A collective helical-elements structure as set forth in claim 1, wherein a plurality of groups of helical elements are united side by side in mutually opposite winding directions of the helix, each group comprising a plurality of helical elements united side by side in a same winding direction of the helix.

5. A collective helical-elements structure as set forth in claim 2, wherein a first plurality of helical elements united side by side in the same winding direction of the helix are coupled side by side with a second plurality of helical elements in the opposite winding direction of the helix.

6. A collective helical-elements structure as set forth in claim 1, wherein said collective helical-elements structure is used as a structure for buildings such as pillar, wall, and board materials or the like.

7. A collective helical-elements structure, comprising a number of helical elements each having troughs and crests and forming a helix, the helical elements being collectively solidified with their respective troughs and crests engaged side by side and each of the helical elements being made of a wiry material helically wound such that the diameter of the helix is about two times the diameter of the helical element, the trough of each helical element being located outside the center of a respective helix, and respective spaces formed in the troughs being in a discontinuous condition along the center of the helix.

8. The collective helical-elements structure as defined by claim 7, wherein respective helical elements having respective troughs and crests engaged side by side are disposed in a same winding direction of the helix.

9. The collective helical-elements structure as defined by claim 7, wherein respective helical elements having respective troughs and crests engaged side by side are disposed in a mutually opposite winding direction of the helix.

10. The collective helical-elements structure defined by claim 7, wherein a plurality of helical elements having respective troughs and crests engaged side by side in a same winding direction of the helix are collectively solidified into groups of the helical elements, and wherein the groups of helical elements are combined and solidified in a mutually opposite winding direction of the helix.

11. The collective helical-elements structure as defined by claim 7, wherein a first plurality of helical elements having a first winding direction of the helix are intermixed with a second plurality of helical elements in a second winding direction of the helix, and wherein the helical elements are collectively solidified with their troughs and crests engaged side by side.

12. A collective helical-elements structure, comprising a number of helical elements each having troughs and crests and forming a helix, the helical elements being collectively solidified with their respective troughs and crests engaged side by side and each of the helical elements being helically would such that the diameter of the helix is two times the diameter of the helical element, the trough of each helical element being located outside the center of a respective helix, and respective spaces formed in the troughs being in a discontinuous condition along the center of the helix.

* * * * *